US010359238B2

(12) United States Patent
Johnson et al.

(10) Patent No.: US 10,359,238 B2
(45) Date of Patent: Jul. 23, 2019

(54) HEAT EXCHANGER AND SIDE PLATE

(71) Applicant: Modine Manufacturing Company, Racine, WI (US)

(72) Inventors: Mark Johnson, Racine, WI (US); Bradley Engel, Waterford, WI (US); George Baker, Waterford, WI (US); Nicholas Siler, Cedarburg, WI (US); Brian Merklein, Hartford, WI (US)

(73) Assignee: Modine Manufacturing Company, Racine, WI (US)

( * ) Notice: Subject to any disclaimer, the term of this patent is extended or adjusted under 35 U.S.C. 154(b) by 428 days.

(21) Appl. No.: 15/030,966

(22) PCT Filed: Oct. 22, 2014

(86) PCT No.: PCT/US2014/061766
§ 371 (c)(1),
(2) Date: Apr. 21, 2016

(87) PCT Pub. No.: WO2015/061447
PCT Pub. Date: Apr. 30, 2015

(65) Prior Publication Data

US 2016/0238325 A1 Aug. 18, 2016

Related U.S. Application Data

(60) Provisional application No. 61/894,476, filed on Oct. 23, 2013.

(51) Int. Cl.
*F28F 9/00* (2006.01)
*F28D 1/053* (2006.01)
(Continued)

(52) U.S. Cl.
CPC ..... *F28F 9/001* (2013.01); *F25B 39/00* (2013.01); *F28D 1/05391* (2013.01); *F28F 3/025* (2013.01); *F28F 2265/26* (2013.01)

(58) Field of Classification Search
CPC .. F28F 9/001; F28F 2265/26; F28F 2009/004; F28F 2225/00
See application file for complete search history.

(56) References Cited

U.S. PATENT DOCUMENTS 5,954,123 A 9/1999 Richardson
5,964,281 A 10/1999 Voss et al.
(Continued)

FOREIGN PATENT DOCUMENTS

CN 1104761 7/1995
CN 1155067 7/1997
(Continued)

OTHER PUBLICATIONS

Office Action from the Japanese Intellectual Property Office for Application No. JP2016526198 dated Jul. 12, 2017 (13 pages).
(Continued)

*Primary Examiner* — Eric S Ruppert
(74) *Attorney, Agent, or Firm* — Michael Best & Friedrich LLP; Jeroen Valensa; Michael Bergnach

(57) ABSTRACT

A side plate for use in a heat exchanger having a width dimension and a first and a second row of parallel arranged tubes extending in the direction of the width dimension. A first and a second header are arranged at one common end of the width dimension to receive the ends of the tubes in the first and second rows, respectively. The side plate includes a first body section joined to and extending from the first header, the first body section defining a first outer periphery. The side plate includes a second body section joined to and extending from the second header, the second body section defining a second outer periphery. The second outer periphery is spaced apart from the first outer periphery such that
(Continued)

each one of the first and second body sections is allowed to more relative to the other in the direction of the width dimension.

20 Claims, 5 Drawing Sheets

(51) Int. Cl.
*F25B 39/00* (2006.01)
*F28F 3/02* (2006.01)

(56) References Cited

U.S. PATENT DOCUMENTS

| | | | | |
|---|---|---|---|---|
| 6,412,547 | B1 * | 7/2002 | Siler | F28F 9/001 165/149 |
| 7,108,050 | B2 | 9/2006 | Reichle et al. | |
| 7,198,095 | B2 | 4/2007 | Nguyen | |
| 7,231,966 | B2 | 6/2007 | Katoh et al. | |
| 7,389,810 | B2 | 6/2008 | Harada | |
| 7,594,327 | B2 | 9/2009 | Nakayama et al. | |
| 7,621,317 | B2 | 11/2009 | Rousseau et al. | |
| 7,921,902 | B2 | 4/2011 | Horoho | |
| 8,136,579 | B2 | 3/2012 | Riondet et al. | |
| 8,776,873 | B2 | 7/2014 | Mross et al. | |
| 8,794,300 | B2 | 8/2014 | Irmler et al. | |
| 2002/0023735 | A1 | 2/2002 | Uchikawa et al. | |
| 2004/0251002 | A1 * | 12/2004 | Reichle | F28D 1/0435 165/149 |
| 2005/0102836 | A1 * | 5/2005 | Kroetsch | F28D 1/05366 29/890.054 |
| 2005/0121178 | A1 | 6/2005 | Nguyen | |
| 2005/0224219 | A1 | 10/2005 | Reier et al. | |
| 2006/0086486 | A1 | 4/2006 | Sudo | |
| 2007/0175619 | A1 | 8/2007 | Watanabe et al. | |
| 2007/0256819 | A1 | 11/2007 | Alcaine et al. | |
| 2007/0261820 | A1 | 11/2007 | Rousseau et al. | |
| 2008/0047689 | A1 | 2/2008 | Hirose et al. | |
| 2008/0190596 | A1 | 8/2008 | Bachner | |
| 2009/0007593 | A1 | 1/2009 | Kerler et al. | |

FOREIGN PATENT DOCUMENTS

| | | | |
|---|---|---|---|
| DE | 112007000019 | | 12/2012 |
| GB | 2452785 | | 3/2009 |
| JP | H09210591 | A | 8/1997 |
| JP | H11325783 | | 11/1999 |
| JP | 2004225990 | | 8/2004 |
| JP | 2005172357 | A | 6/2005 |
| JP | 2008014622 | A | 1/2008 |
| JP | 2008281258 | * | 11/2008 |
| JP | 2013213755 | | 10/2013 |
| WO | 2013058953 | | 4/2013 |

OTHER PUBLICATIONS

First Office Action from the State Intellectual Property Office of China for Application No. 201480058348.4 dated Feb. 3, 2017 (16 pages).
PCT/US2014/061766 International Preliminary Report on Patentability dated Apr. 26, 2016 (1 pages).
International Search Report and Written Opinion for Application No. PCT/US2014/061766 dated May 28, 2015 (12 pages).

* cited by examiner

HEAT EXCHANGER AND SIDE PLATE

BACKGROUND

The present invention relates to heat exchangers, and to side plates used in heat exchangers.

Vapor compression systems are commonly used for refrigeration and/or air conditioning and/or heating, among other uses. In a typical vapor compression system, a refrigerant, sometimes referred to as a working fluid, is circulated through a continuous thermodynamic cycle in order to transfer heat energy to or from a temperature and/or humidity controlled environment and from or to an uncontrolled ambient environment. While such vapor compression systems can vary in their implementation, they most often include at least one heat exchanger operating as an evaporator, and at least one other heat exchanger operating as a condenser.

One especially useful type of heat exchanger used in some such systems is the parallel flow (PF) style of heat exchanger. Such a heat exchanger can be characterized by having multiple, parallel arranged channels, especially micro-channels, for conducting the refrigerant through the heat transfer region from an inlet manifold to an outlet manifold.

In part to increase the performance of vapor compression systems, parallel flow heat exchangers having multiple tube rows are being proposed for both condenser and evaporator use. Such heat exchanger architectures can result in different thermal gradients occurring within each of the rows, and can lead to thermal stress concerns that are substantially different than those found in more conventional single row heat exchangers.

SUMMARY

According to an embodiment of the invention, a side plate is provided for use in a heat exchanger. The heat exchanger has a width dimension, and includes a first and a second row of parallel arranged tubes. Each of the tubes extends in the direction of the width dimension. A first and a second header are arranged at one common end of the width dimension to receive the ends of the tubes in the first and second rows, respectively. The side plate includes a first body section joined to and extending from the first header, the first body section defining a first outer periphery. The side plate also includes a second body section joined to and extending from the second header, the second body section defining a second outer periphery. The second outer periphery is spaced apart from the first outer periphery such that each one of the first and second body sections is allowed to more relative to the other in the direction of the width dimension.

In some embodiments, one or more point connections are provided between the first body section and the second body section. Each of the point connections breaks in shear when one of the first and second body sections moves relative to the other in the direction of the width dimension. In some embodiments at least one of the first and second body sections of the side plate includes a planar base and a bent flange joined to the planar base.

In some embodiments the side plate includes a third body section arranged away from the first and second headers and defining a third outer periphery. The third outer periphery is spaced apart from the first and the second outer peripheries such that each of the first and second body sections is allowed to move relative to the third body section in the direction of the width dimension. In some such embodiments the third body section is arranged away from the first and second headers by a distance of no less than one tenth of the width dimension. In some embodiments the first body section is disposed directly over the first row of tubes and the second body section is disposed directly over the second row of tubes.

According to another embodiment of the invention, a side plate for use in a heat exchanger includes a substantially planar base section having a long dimension between opposing first and second short sides, and a short dimension between opposing first and second long sides. One or more first elongated slots extends through the substantially planar base section at an approximately central position in the short dimension, and is oriented to be aligned with the long dimension. The slots extend in the long dimension direction from the first short side to a first terminating location positioned a fraction of the long dimension away from the first short side. One or more second elongated slots extend through the substantially planar base section and are generally oriented to be at an angle to the long dimension. The second elongated slots extend from approximately the first terminating location to a second terminating location. The second terminating location is coincident with the first long side and is located further away from the first short side than the first terminating location In some embodiments a first breaking point is located at approximately the first terminating location and separates the second elongated slots from the first elongated slots. In some embodiments the side plate includes a bent flange joined to the substantially planar base section at the first long side, and one or more third elongated slots extending through the bent flange at approximately the second terminating location.

In some embodiments the side plate includes one or more third elongated slots extending through the substantially planar base section and generally oriented to be at an angle to the long dimension. The third elongated slots extend from approximately the first terminating location to a third terminating location, which is coincident with the second long side and is located further away from the first short side than the first terminating location.

According to another embodiment of the invention, a heat exchanger includes first and second tubular headers arranged adjacent to one another at one end of the heat exchanger, a first tube joined to and extending from the first tubular header in a core width direction of the heat exchanger, and a second tube joined to and extending from the second tubular header in the core width direction. The first tube is one of a first row of tubes, and the second tube is one of a second row of tubes. A flat outer surface of the second tube is arranged to be co-planar with a flat outer surface of the first tube. The heat exchanger further includes a corrugated fin having a plurality of flanks joined by alternating crests and troughs. The troughs are joined to the flat outer surfaces of the first and second tubes. A side plate has a planar base section that is joined to the crests of the corrugated fin. A first slot extends through the planar base section and is disposed between the first and second tubes, and a second slot extends through the planar base section and is disposed over the first tube.

In some embodiments, the side plate includes a third slot extending through the planar base section and disposed over the second tube. In some embodiments the second slot is separated from the first slot by a breaking point. In some embodiments the first tube is fluidly connected to the second tube to at least partially define a fluid flow path from the first header to the second header.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The present invention will be described hereinafter as a refrigerant heat exchanger such as, for example, an evaporator, a condenser, or a heat exchanger capable of operation as both a condenser and an evaporator in a reversible system. However, it should be understood that the invention is applicable to other types of heat exchangers as well, including but not limited to radiators, charge-air coolers, oil coolers, and the like.

Figure 1:
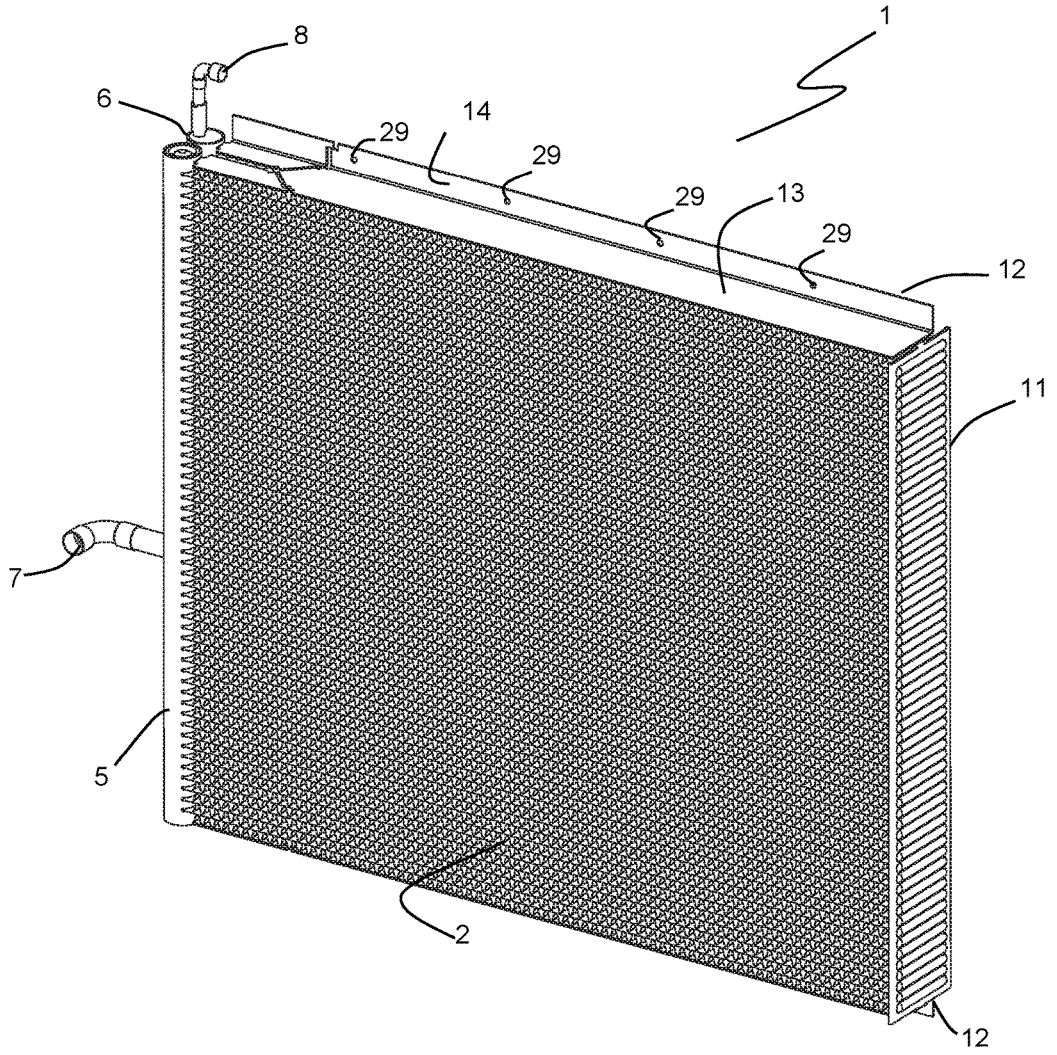
FIG. 1 is a perspective view of a heat exchanger according to an embodiment of the invention.
Figure 2:
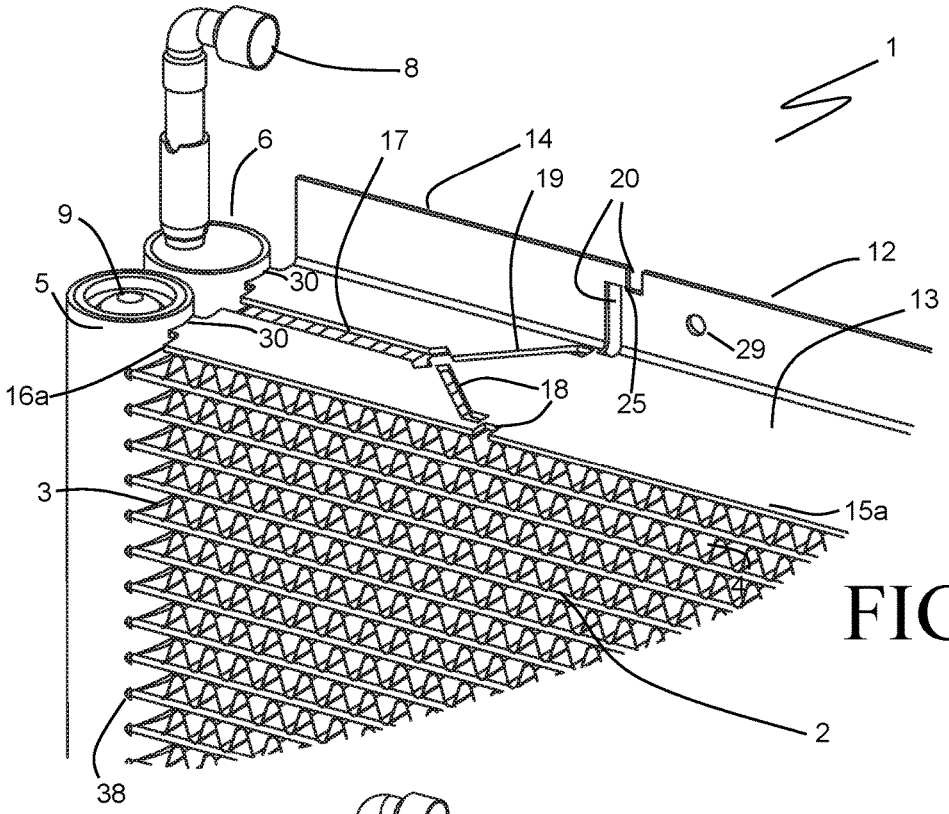
FIG. 2 is a partial perspective view showing details of a portion of the heat exchanger of FIG. 1.
Figure 3:
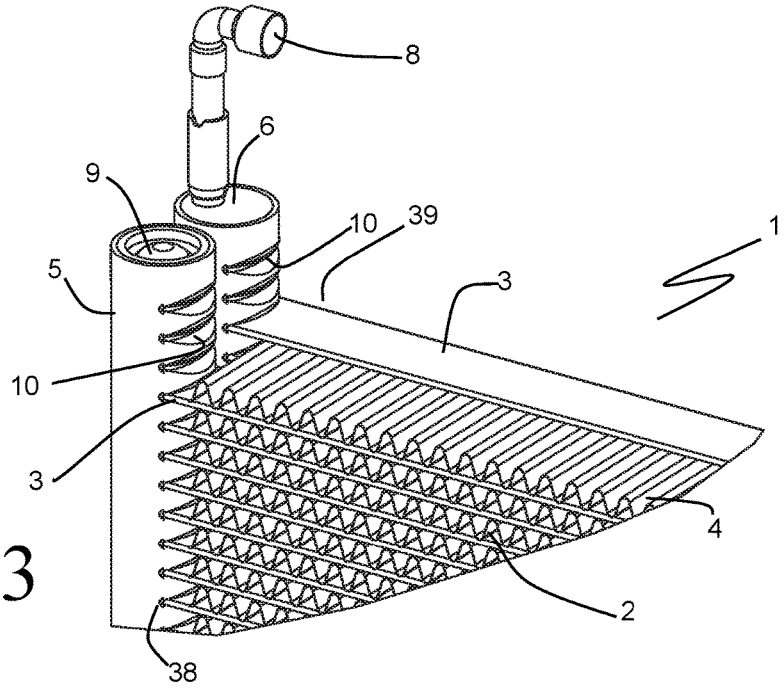
FIG. 3 is similar to FIG. 2, but with certain components removed for clarity.

Referring to FIGS. 1-3, the heat exchanger 1 is of a parallel-flow micro-channel construction. Such a construction provides for efficient transfer of heat between a refrigerant and a flow of air. The refrigerant travels through so-called micro-channels extending through the interiors of flat tubes 3, while the flow of air passes over the surfaces of convoluted fins 4 arranged between and bonded to the flat tubes 3, so that the flow of air travels over the tubes 3 in a direction that is generally perpendicular to the flow of refrigerant through the tubes 3. The alternating arrangement of fins 4 and flat tubes 3 defines a core 2 of the heat exchanger 1.

The convoluted fins 4 are generally of a serpentine design, and are defined by flanks joined by alternating crests and troughs. The flanks provide a large amount of surface area to facilitate convective heat transfer to or from the flow of air passing over the fin surfaces. The crests of a fin 4 join to the flat surface of a tube 3 on one side of the convoluted fin 4, whereas the troughs join to the flat surface of a tube 3 on the opposite side of the fin 4. While the convoluted fins 4 of the accompanying figures are shown to be plain fins absent of heat transfer enhancement features such as bumps, slits, louvers, or the like, it should be appreciated by those skilled in the art that such known enhancement features can be provided on the flanks of the fins 4.

In addition to the core 2, the heat exchanger 1 further includes a tubular inlet header 5 and a tubular outlet header 6. The headers 5 and 6 are arranged in side-by-side fashion at a common end of the heat exchanger. Each of the tubular headers 5 and 6 is provided with a series of tube slots 10 penetrating through an outer wall of each header 5, 6 and facing towards the core 2. The number of tube slots 10 is in like proportion to the number of tubes 3, so that an end of each of the tubes 3 can be received into one of the tube slots 10 in order to provide for a fluid flow path from the interiors of the tubular headers 5, 6 to the micro-channels provided within the tubes 3. As shown in FIG. 2, open ends of the tubular headers 5 and 6 can be closed off with a cap 9, or with an end port connection such as the port 8, which will be described later in greater detail.

As shown in FIG. 1, the heat exchanger 1 further includes a rather flat return header 11 arranged at a side of the heat exchanger 1 opposite the headers 5 and 6. The rather flat return header 11 is described in greater detail in co-pending U.S. patent application Ser. No. 13/076,607, published as US2011-0240271 A1, but in general the return header 11 includes tube slots to receive ends of the flat tubes 3, and provides for fluid communication between the micro-channels of those flat tubes 3 joined to the inlet header 5, and the micro-channels of those flat tubes 3 joined to the outlet header 6. In this manner, a plurality of fluidly parallel flow paths for the refrigerant are provided between the inlet header 5 and the outlet header 6. It should be noted, however, that other embodiments of the invention might provide a similar plurality of flow paths without the use of the rather flat header 11, such as for example by utilizing another pair of tubular headers at that end of the heat exchanger 1 to receive the ends of the tubes 3. In any event, the exposed length of the flat tubes 3 between the headers 5, 6 at one end of the core 2 and the return header 11 at the other end of the core 2 defines a width dimension of the heat exchanger 1, as it provides a flow area boundary for the air moving through the core 2.

The heat exchanger 1 as shown in FIGS. 1-3 can be described as a two row heat exchanger, owing to the arrangement of the flat tubes 3 into a first row 38 (consisting of those tubes 3 with ends received into the inlet header 5) and a second row 39 (consisting of those tubes 3 with ends received into the outlet header 6). As shown in FIG. 3, a single convoluted fin 4 can extend across aligned tubes 3 of both rows 38 and 39. Alternatively, separate ones of the fins 4 can be used for each row.

In order to allow for the interconnection of the heat exchanger 1 into a refrigerant system, the heat exchanger 1 is further provided with an inlet port 7 and an outlet port 8. The inlet port 7 is connected to the inlet header 6 to allow the refrigerant circulating through the refrigerant system to enter into the heat exchanger 1, while the outlet port 8 is connected to the outlet header 6 to allow the refrigerant to exit the heat exchanger 1 after having circulated through the core 2. A particularly preferable refrigerant system incorporating the heat exchanger 1 is shown in FIG. 6, and will now be described in more detail with specific reference to that figure and FIG. 7.

Figure 6:
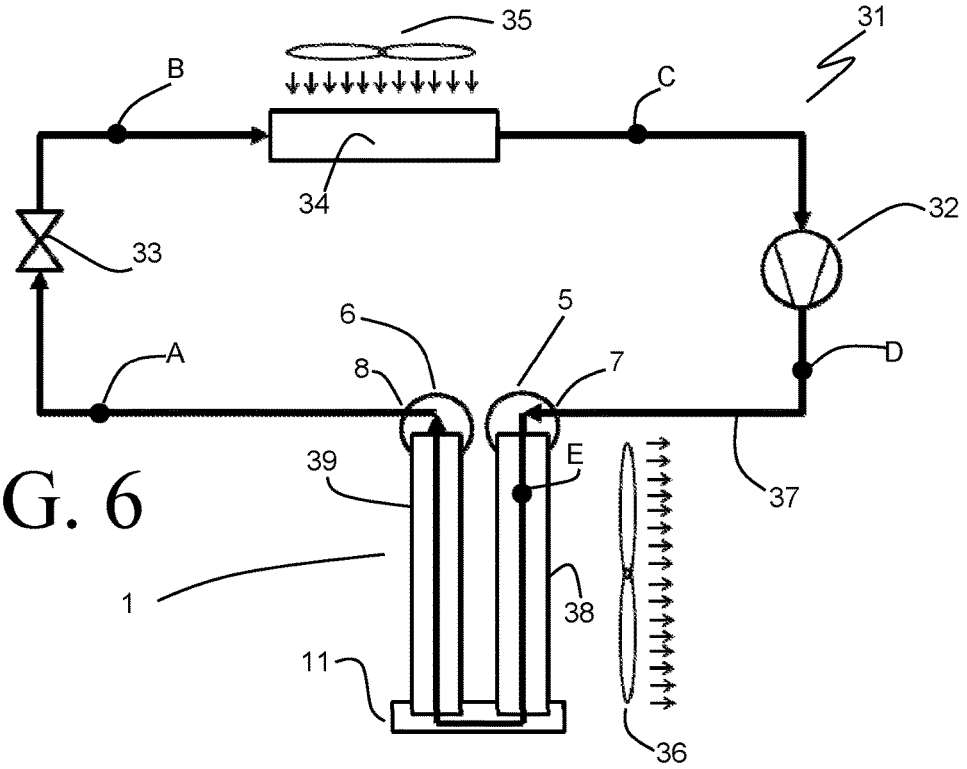
FIG. 6 is a schematic view of a vapor compression system including the heat exchanger of FIG. 1.

FIG. 6 depicts, in schematic fashion, a refrigerant system 31 that includes the heat exchanger 1. In the configuration shown, the heat exchanger 1 functions as a condenser to remove heat from a flow of refrigerant 37 that traverses through the system 31. A compressor 32 receives a superheated refrigerant at low pressure (corresponding to the point C along the refrigerant flow path) and compresses the refrigerant to a higher pressure (corresponding to point D). The pressurized refrigerant is received into the inlet header 5 of the heat exchanger 1 by way of the inlet port 7, and passes sequentially through the first row of tubes 38, the return header 11, and the second row of tubes 39, before being received into the outlet header 6.

As the refrigerant 37 travels through the tubes, heat is removed from the refrigerant by air that is directed over the tubes by an air mover 36. The air flow is represented by arrows extending from the air mover 36, and as depicted in FIG. 6 the heat exchanger 1 is located upstream of the air mover 36 such that the air is pulled first over the tubes in the row 39, and next over the tubes in the row 38, thereby resulting in counter-cross heat exchange between the refrigerant and the air. It should be recognized that in some alternative configurations of the system 31 the direction of the air flow through the heat exchanger 1 might be reversed, so that the air passes first over the tubes in the row 38 and second over the tubes in the row 39. Such concurrent-cross heat exchange would be less effective than the counter-cross arrangement shown, but may result in other system advantages. It should also be noted that the air mover 36 could alternatively be located upstream of the heat exchanger 1, so that the air is pushed through the heat exchanger 1 by the air mover 36, rather than being pulled through.

At some point (specifically, point E) within the first row of tubes 38, and typically fairly close to the inlet header 5, the refrigerant reaches its saturation temperature. From there on, the refrigerant maintains an essentially constant temperature as it releases latent heat through condensation to a liquid phase. The refrigerant 37 leaves the outlet header 6 by way of the outlet port 8 as a slightly sub-cooled liquid refrigerant at the elevated pressure (corresponding to the point A). The refrigerant is then expanded to the lower pressure through an expansion valve 33, thereby flashing to a two-phase (liquid and vapor) condition (corresponding to point B). The refrigerant is subsequently routed through an evaporator 34. Heat is transferred to the refrigerant as it passes through the evaporator 34, so that the refrigerant exits the evaporator 34 as the superheated refrigerant of point C. This transfer of heat within the evaporator can be used to cool and/or dehumidify a flow of air provided by an air mover 35 and passing through the evaporator 34, making the system 31 useful for climate comfort, refrigeration, or other similar purposes. Alternatively, the transfer of heat within the evaporator can be used for other purposes, for example to produce a chilled water supply.

In some embodiments, the refrigerant system 31 can be modified to be a reversible heat pump system. In such a system, one or more valves are arranged along the flow path of the refrigerant to selectively allow for operation of the system in either the mode described above, or a reversed mode in which the heat exchanger 34 functions as the condenser and the heat exchanger 1 functions as the evaporator. In such a reversed mode, the flow of refrigerant through each of the heat exchangers is reversed from that shown in FIG. 6, so that two-phase low-pressure refrigerant enters the heat exchanger 1 through the port 8, and exits the heat exchanger 1 through the port 7.

Figure 7:
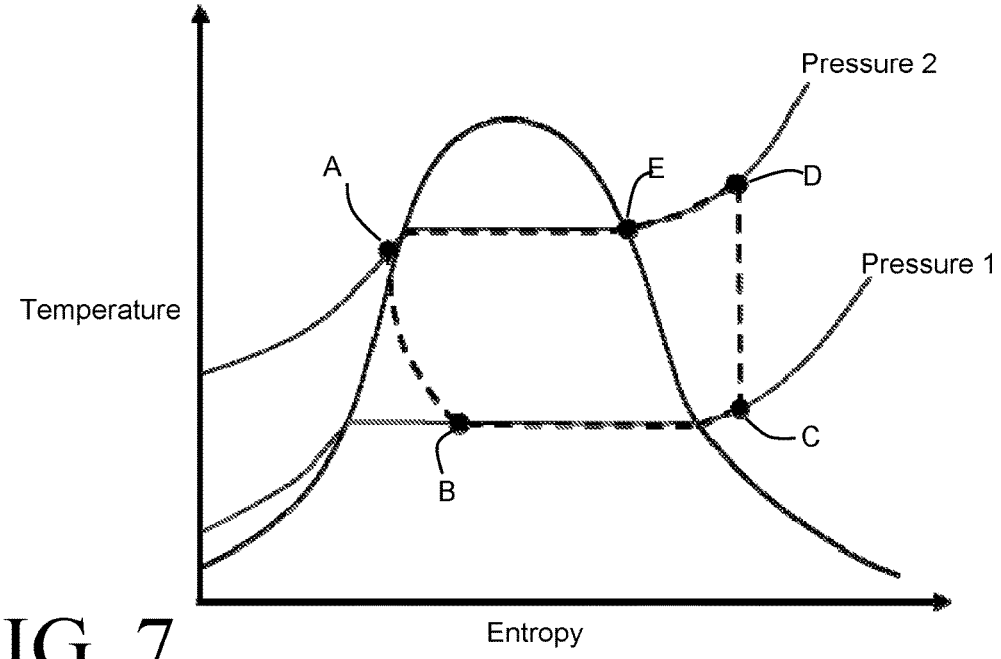
FIG. 7 is a temperature vs. entropy plot showing the thermodynamic cycle of the system of FIG. 6.

Turning now to FIG. 7, the points A through E are shown plotted on a temperature vs. entropy curve for the refrigerant, with dashed lines between the points to depict the thermodynamic cycle of the refrigerant circulating through the system 31 as shown in FIG. 6. The refrigerant traverses the depicted thermodynamic cycle shown in a counterclockwise direction. Consecutively arranged points D, E, and A of the cycle all reside on an isobar labeled as "Pressure 2", corresponding to the elevated pressure of the refrigerant after leaving the compressor 32. Points B and C both reside on an isobar labeled "Pressure 1", corresponding to the lower pressure of the refrigerant downstream of the expansion valve 33. As can be seen from the plot, the temperature of the refrigerant in the superheat portion of the heat exchanger 1, which corresponds to the change from point D to point E, declines sharply. In comparison, the remainder of the refrigerant flow path through the heat exchanger 1 remains at a fairly constant temperature. This can lead to certain durability issues for the heat exchanger 1.

Referring back to FIGS. 1-2, it can be seen that the heat exchanger 1 further includes side plates 12 arranged at opposing ends of the core 2. Such side plates 12 are known to provide several benefits for the heat exchanger 1. During the construction of the heat exchanger 1, it is often necessary to compress the core 2 in order to properly align the ends of the tubes 3 with the tube slots 10 provided in the headers. The compression is then maintained while the various parts of the heat exchanger 1 are joined together in a brazing operation, such compression being necessary to ensure that the fins 4 and the tubes 3 are properly bonded. The inclusion of side plates 12 provides a convenient way to apply and maintain the compression load on the core 2, as each side plate 12 provides a planar base section 13 that bears against, and is bonded to, the crests or troughs of an outermost one of the convoluted fins 4.

Generally speaking, the side plate 12 is of a rectangular shape, with two spaced apart long sides 15*a* and 15*b* extending in the direction of the core width dimension, and two spaced apart short sides 16*a* and 16*b* at the header ends of the side plate 12. The side plate 12 can additionally be provided with a bent flange 14 extending from the planar base 13 along one or both the long sides 15. The bent flange 14 can provide increased structural rigidity to the side plate 12, as well as optionally providing mounting holes 29 for installation of the heat exchanger 1. While the exemplary embodiment shows only a single bent flange along the long side 15*a*, a similar bent flange can also be provided along the opposing long side 15*b*. In any event, the bent flange is an optional feature and need not be present in all embodiments of the invention.

The side plate 12 also includes edges 30 arranged along the short side 16*a* to structurally join the side plate 12 to the headers 5 and 6. Such a structural connection is known to provide beneficial strengthening of the tubular headers to allow them to resist the pressure forces that may be imposed upon them by the pressurized refrigerant contained within. The connection between the headers 5, 6 and the edges 30 can be provided by welding and/or by brazing. Similar connections can be provided at the opposing short 16*b*, but are generally not necessary when the rather flat return header 11 is employed.

The components of the heat exchanger 1 can be joined into a monolithic assembly through a brazing operation. Preferably, all of the components are formed from a similar metal alloy (such as, for example, an aluminum alloy), and a braze filler metal having a lower melting point than that alloy is provided at the joints between components. The assembled components are placed into a brazing furnace at high temperature, such that the braze filler metal becomes liquid and wets the adjoining surfaces. When the temperature is sufficiently reduced, the filler metal re-solidifies to permanently join the various components.

Heat exchangers (specifically, condensers) having a similar construction, but with only a single row of flat tubes extending between spaced apart tubular headers, are known to be sensitive to damage incurred by differential thermal expansion between the tubes and the side plate during operation. The refrigerant passing through the tubes of a condenser is by necessity at an elevated temperature with respect to the cooling air flow. In contrast, the side plate is at a temperature that is generally equal to the cooling air temperature. As a result, the tubes would ordinarily experience a greater amount of thermal expansion that the side plate. The tubes and the side plates are constrained, however, by virtue of being joined to the opposing headers. Consequently, this differential thermal expansion results in stresses at the header, and can lead to premature failure of the heat exchanger. This known problem has in the past been alleviated by cutting or sawing through the side plate after the construction of the heat exchanger, or by including breaking features in the side plate, as described in U.S. Pat. No. 6,412,547 to Siler and U.S. Pat. No. 7,621,317 to Rousseau et al., among others. Such solutions avoid the thermal stress issues while still providing the beneficial strengthening of the tubular headers against internal pressure as described earlier.

The inventors have found that these known solutions can be insufficient for use in the multi-row heat exchanger 1 when that heat exchanger operates as a refrigerant condenser. As indicated by the plot of FIG. 7, the temperature of the first row of tubes 38 in the vicinity of the inlet header 5 (corresponding to that portion of the refrigerant flow path between the points D and E) can be substantially higher than the temperature of the second row of tubes 39 at that end of the heat exchanger 1. Thus, even if the side plate 12 is severed between the short sides 16*a* and 16*b*, the portion of the side plate 12 overlying that portion of the tubes 3 adjacent the headers 5 and 6 can prevent the tubes 3 of each row 38 and 39 from thermally expanding to their different desired lengths, leading to stresses at the headers.

As a solution to this problem, the inventors have found that certain features can be added to the side plate 12 in order to allow for the tube rows 38 and 39 to expand as needed while still maintaining the known benefits of the side plate. These features will now be described with specific reference to the embodiments shown in FIGS. 4 and 5.

Figure 4A:
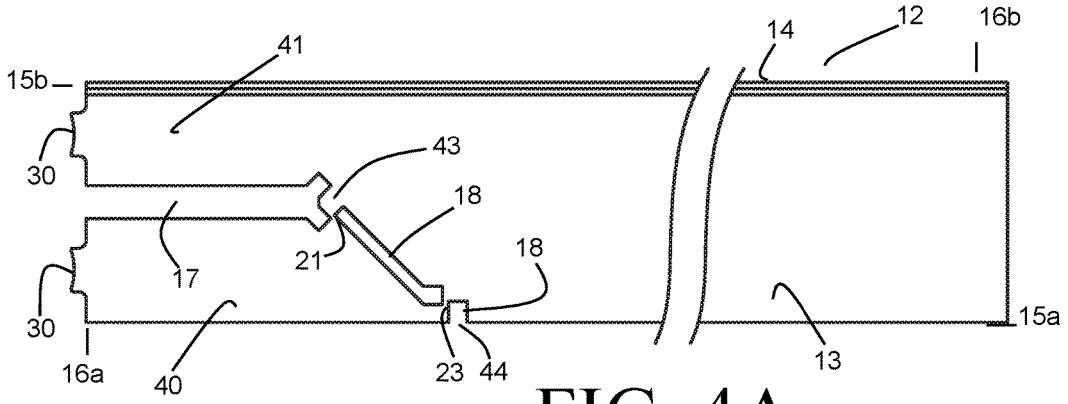
FIGS. 4A-C are plan views of a side plate according to an embodiment of the invention.
Figure 4B:
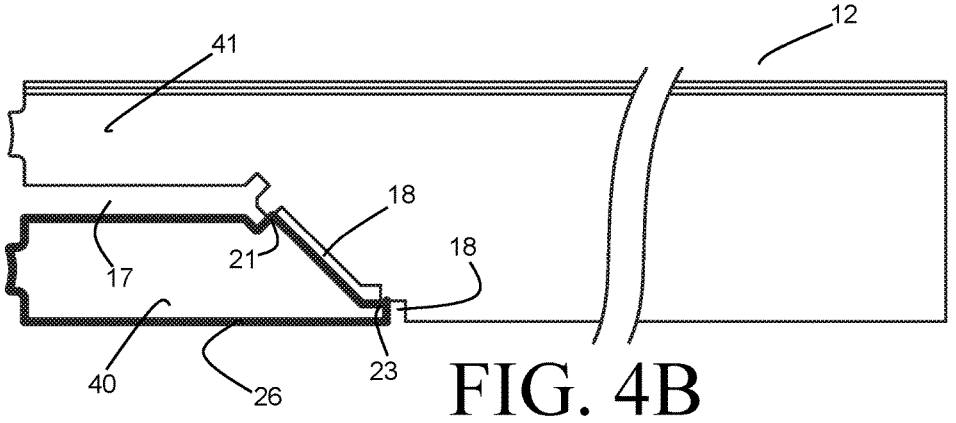
Figure 4C:
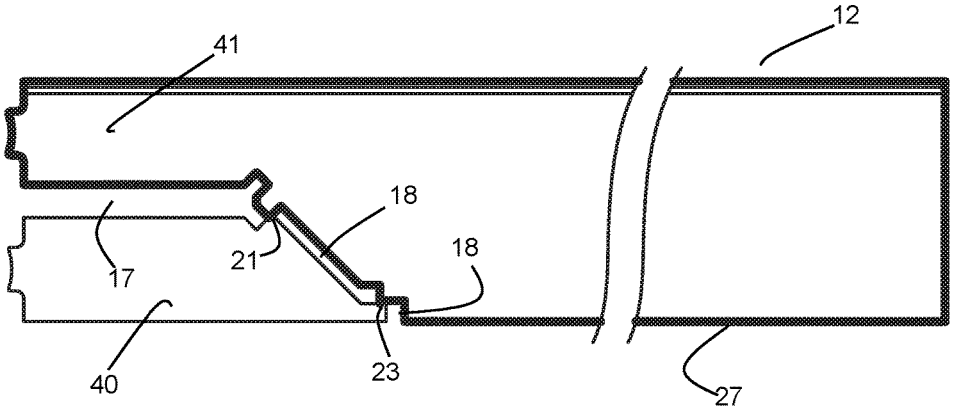
Figure 5A:
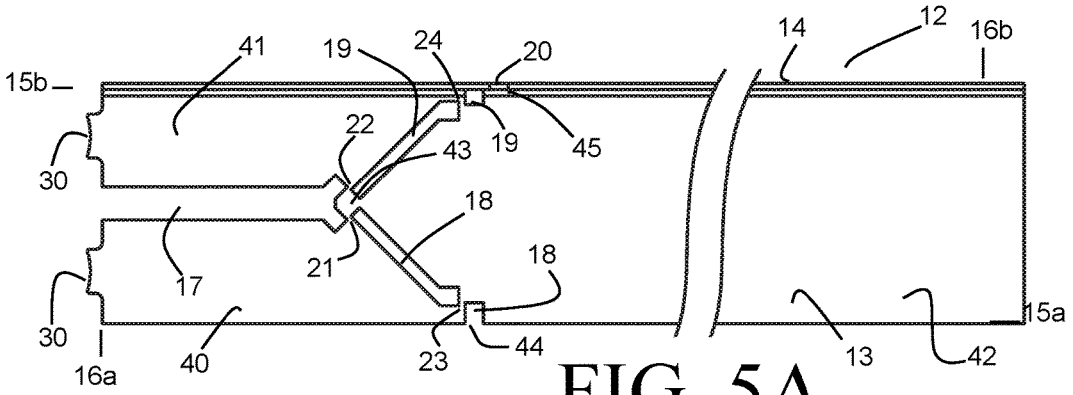
FIGS. 5A-D are plan views of a side plate according to another embodiment of the invention.
Figure 5B:
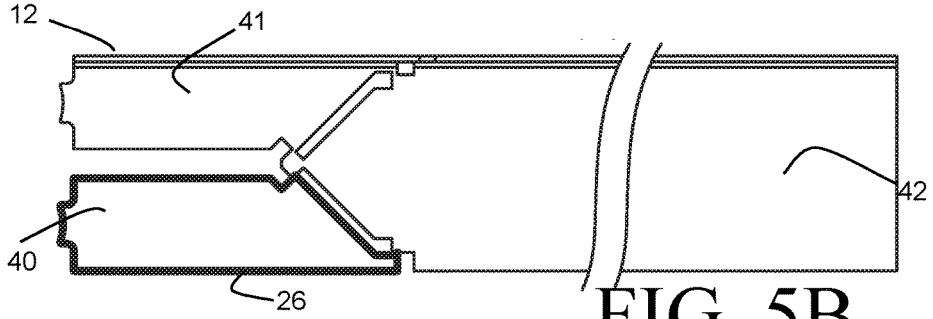
Figure 5C:
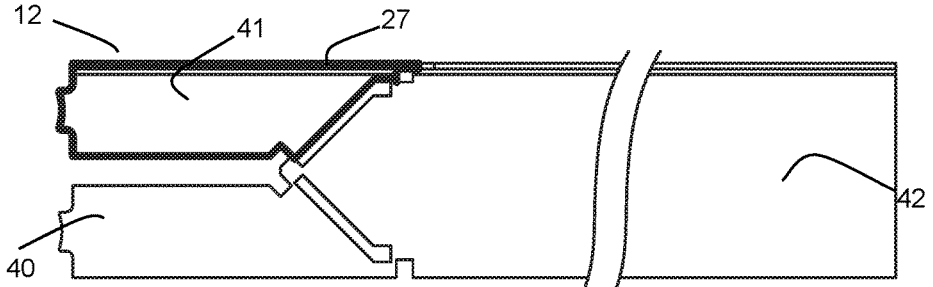
Figure 5D:
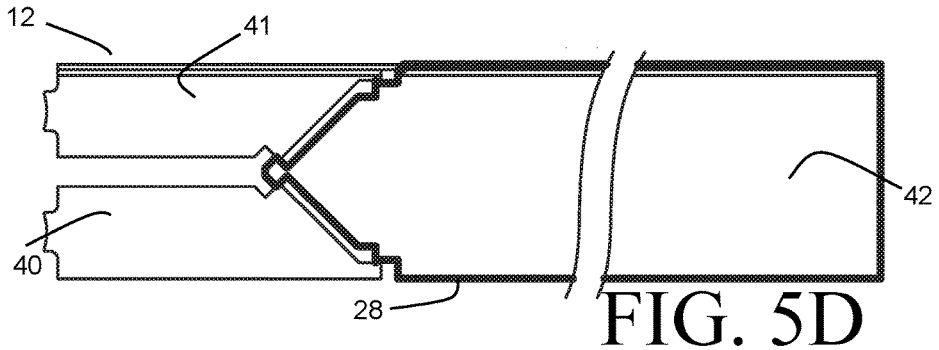

The side plate 12 of FIGS. 4A-4B is divided into a first body section 40, and a second body section 41. The body section 40 defines an outer periphery 26, shown in darker outline in FIG. 4B. Similarly, the body section 41 defines an outer periphery 27, shown in darker outline in FIG. 4C. Slots 17 and 18 extend through the substantially planar base section 13 of the side plate 12, and provide spacing between the body sections 40 and 41 so that those body sections are able to move relative to one another in the direction of width dimension of the heat exchanger 1 (i.e. parallel to the long sides 15). The body section 40 is joined, by way of an edge 30, to the inlet header 5, so that the inlet header 5 is reinforced against internal pressure. Similarly, the body section 41 is joined by another edge 30 to the outlet header 6 for the same purpose.

The slot 17 is elongated in the direction of the width dimension, is located to be approximately midway between the rows 38 and 39 of the core 2, and extends from the short side 16*a* to a terminating location 43 spaced a distance away from that side. The terminating location 43 is preferably selected to approximately correspond to the point E during expected operation of the heat exchanger 1. Such a desired location can often be estimated as a percentage of the overall width dimension of the heat exchanger. For example, in some preferable embodiments the terminating location is spaced away from the short side 16*a* by a distance that is approximately one tenth of the width dimension.

The embodiment of FIG. 4 shows two slots 18 extending from the terminating location 43 to a second terminating location 44 located along the long edge 15*a*, so that the slots 18 are disposed over the first row of tubes 38 in the heat exchanger 1. The terminating location 44 is spaced further away from the short edge 16*a* than is the terminating location 43, thereby resulting in the slots 18 extending at an angle to the width dimension direction. By extending at an angle (approximately 45 degrees in the depicted embodiment) the slots 18 can cross over multiple convolutions of the fin 4, and can furthermore avoid being aligned with the weak moment of inertia axis of the flat tubes 3. The width of each slot 18 can be selected to provide sufficient room so that the expected difference in thermal expansion between the tube rows does not completely close the gap between the outer peripheries 27 and 27 created by the slot 18.

Point connections are provided between the body sections 40 and 41 to allow for handling and assembly of the side plate 12 as a single component during manufacturing of the heat exchanger. A first point connection 21 is provided at the terminating location 43, and separates a slot 17 from a slot 18. The point connection 21 is preferably configured to break in shear when relative movement in the width dimension direction occurs between the body sections 40 and 41. The point connection 21 can thereby remain intact until the operation of the heat exchanger induces a sufficient differential thermal expansion between the rows of tubes to break the point connection 21. While only a single, continuous slot 17 is shown in the embodiment of FIG. 4, in some alternative embodiments additional point connections similar to point connection 21 can be provided so that multiple slots 17 are defined, adjacent ones of the slots 17 being separated by one such point connection.

In similar fashion, one or more point connections 23 (only one is shown) can be provided to connect the outer periphery 26 to the outer periphery 27 between adjacent ones of the slots 18. The point connections 23 can again provide some structural integrity to the side plate 12 during handling and assembly, but will break in shear to allow for relative movement of the body sections 40 and 41 in the width dimension direction.

Another embodiment of the side plate 12 is illustrated in FIG. 5, and is the embodiment of the side plate 12 shown in the heat exchanger 1 of FIGS. 1 and 2. Elements in the embodiment of FIG. 5 that are the same or similar to elements in the embodiment of FIG. 4 are identified with like numbers. In this embodiment, the side plate 12 is divided into a first body section 40, a second body section 41, and a third body section 42. As was the case in the embodiment of FIG. 4, the body section 40 defines an outer periphery 26 and includes an edge 30 to allow for attachment to the inlet header. Similarly, the body section 41 defines an outer periphery 27 and includes another edge 30 to allow for attachment to the outlet header. The third body section 42 defines an outer periphery 28, and extends between the terminating location 43 and the opposite short side 16*b*. In this embodiment, the slots 18 separate the outer periphery 26 from the outer periphery 28 in order to allow for relative movement in the width dimension direction between the body section 40 and the body section 42. The point connection 21, again provided at the terminating location 43, again separates a slot 17 from a slot 18, and can be configured to break in shear when such movement occurs between the body sections 40 and 42.

Slots 19 similar to the slots 18 extend through the substantially planar base section 13 of the side plate 12 and separate the body section 41 from the body section 42. A point connection 22, similar to the point connection 21, is provided at the terminating location 43 and separates a slot 17 from a slot 19. The slots 19 extend from the terminating location 43 to a third terminating location 45 located along the long edge 15*b*, so that the slots 19 are disposed over the second row of tubes 39 in the heat exchanger 1. The terminating location 45 is spaced further away from the short edge 16*a* than is the terminating location 43, so that the slots 18 extend at an angle to the width dimension direction. In some embodiments the terminating locations 44 and 45 are spaced equidistantly from the short edge 16*a*, although this need not be the case in all embodiments.

Slots 20 extend through the flange 14 of the side plate 12 and intersect with the slot 19 extending through the base section 13 at the terminating location 45. The slots 20 are elongated in a direction that is generally perpendicular to the planar base section 13, and are offset from one another in the width dimension direction by an amount that is slightly greater than the width of the slots 20. A point connection 25 between the flanges of the body sections 41 and 42 is thereby created, and can break in shear when those body sections move relative to one another in the width dimension direction.

The embodiment of FIG. 5 can be especially beneficial in cases where the side plate 12 is joined to the return header(s) opposite the inlet and outlet headers 5 and 6. In such cases, it may be necessary for both rows of tubes 38 and 39 to be able to thermally expand without being constrained by the side plate 12. The body section 42, being joined to the opposing header(s), is able to move away from both the body sections 40 and 41. Additionally, each of the body sections 40 and 41 is able to move with that one of the headers 5 and 6 to which it is attached, without being constrained by the other or by the body section 42.

As an alternative to relying on the thermal response of an operating heat exchanger 1 to break the point connections 21, 22, 23, 24, and/or 25, one or more of such point connections can be severed after the components of the heat exchanger 1 have been joined together.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A side plate for use in a heat exchanger, the side plate comprising:

a substantially planar base section having a long dimension between opposing first and second short sides, and a short dimension between opposing first and second long sides;

a first elongated slot extending through the substantially planar base section, and oriented to be aligned with the long dimension, the first elongated slot extending in a long dimension direction from the first short side to a first terminating location positioned a fraction of the long dimension away from the first short side; and a second elongated slot extending from the first terminating location to a second terminating location at a non-zero angle to the long dimension direction, the second terminating location being located further away from the first short side than the first terminating location, wherein the first terminating location includes a first breaking point that separates the first elongated slot from the second elongated slot, and wherein the second terminating location includes a second breaking point between the second elongated slot and the first long side.

2. The side plate of claim 1, further comprising:

a bent flange joined to the substantially planar base section at the first long side; and one or more third elongated slots extending through the bent flange from approximately the second terminating location.

3. The side plate of claim 1, further comprising a third elongated slot extending from the first terminating location to a third terminating location at a non-zero angle to the long dimension direction, the third terminating location being located further away from the first short side than the first terminating location, wherein the third terminating location includes a third breaking point between the third elongated slot and the second long side.

4. The side plate of claim 3, further comprising:

a first bent flange joined to the substantially planar base section at the first long side;

a second bent flange joined to the substantially planar base section at the second long side;

one or more fourth elongated slots extending through the first bent flange from approximately the second terminating location; and one or more fifth elongated slots extending through the second bent flange from approximately the third terminating location.

5. The side plate of claim 3, wherein the first terminating location includes a fourth breaking point that separates the first elongated slot from the third elongated slot.

6. The side plate of claim 5, wherein the first elongated slot includes a first corner and a second corner at the first terminating location, wherein the second elongated slot includes a third corner at the first terminating location, wherein the third elongated slot includes a fourth corner at the first terminating location, wherein the first breaking point is located between the first corner and the third corner, and wherein the fourth breaking point is located between the second corner and the fourth corner.

7. The side plate of claim 5, further comprising:

a first body section disposed over a first row of tubes of the heat exchanger;

a second body section disposed over a second row of tubes of the heat exchanger; and a third body section disposed over the first row and the second row, wherein the first body section includes a first periphery defined by the first elongated slot, the second elongated slot, the first breaking point, and the second breaking point, wherein the second body section includes a second periphery defined by the first elongated slot, the second elongated slot, the third breaking point, and the fourth breaking point, and wherein the third body section includes a third periphery defined by second elongated slot, the third elongated slot, the first breaking point, the second breaking point, the third breaking point, and the fourth breaking point.

8. The side plate of claim 3, wherein the first elongated slot is at least partially disposed in a short dimension direction between the second elongated slot and the third elongated slot.

9. The side plate of claim 1, wherein the fraction of the long dimension is no more than one tenth.

10. The side plate of claim 1, wherein said angle is approximately 45 degrees.

11. The side plate of claim 1, wherein the first elongated slot extends a first distance in the long dimension direction from the first side to the first terminating location, wherein the second elongated slot extends a second distance in a short dimension direction tranverse to the long dimension direction, and wherein the first distance is greater than the second distance.

12. The side plate of claim 1, wherein the first elongated slot includes a plurality of first elongated slots.

13. The side plate of claim 1, wherein the first elongated slot is at least partially located in a short dimension direction between a first row of tubes of the heat exchanger and a second row of tubes of the heat exchanger, wherein the first row of tubes in fluidly connected to the second row of tubes.

14. The side plate of claim 1, wherein the first breaking point is offset in a short dimension direction from a center location of the side plate.

15. The side plate of claim 1, wherein the first elongated slot includes a first corner at the first terminating location, wherein the second elongated slot includes a second corner at the first terminating location, and wherein the first breaking point is located between the first corner and the second corner.

16. The side plate of claim 1, wherein the first terminating location includes a first corner and a second corner spaced apart from the first corner, wherein the first terminating location is at least partially located in a short dimension direction between a first row of tubes of the heat exchanger and a second row of tubes of the heat exchanger, wherein the first corner and the second corner are offset from a center location in the short dimension direction of the side plate, wherein the first corner is located between the first elongated slot and the second elongated slot, and wherein the second corner is located between the first elongated slot and a third elongated slot that extends to a second side of the side plate.

17. The side plate of claim 1, further comprising:

a first body section disposed over a first row of tubes of the heat exchanger; and a second body section disposed over the first row of tubes and a second row of tubes of the heat exchanger;

wherein the first body section includes a first periphery defined by a first side of the first elongated slot, a first side of the second elongated slot, the first breaking point, and the second breaking point, wherein the second body section includes a second periphery defined by a second side of the first elongated slot, a second side of the second elongated slot, the first breaking point, and the second breaking point, wherein the first body section is joined to a first header of the heat exchanger, and wherein the second body section is joined to a second header of the heat exchanger.

18. The side plate of claim 1, wherein the first elongated slot extends beyond the first breaking point extending in a first short dimension direction toward the first long side and extends beyond the first breaking point extending in an opposite, second short dimension direction toward the second long side, wherein the second elongated slot extends beyond the first breaking point extending in the first short dimension direction toward the first long side and extends beyond the first breaking point extending in the second short dimension direction toward the second long side, and wherein the second elongated slot extends farther in the first short dimension direction than in the second short dimension direction.

19. A heat exchanger comprising:

first and second tubular headers arranged adjacent to one another at a first end of the heat exchanger;

a return header located a second end of the heat exchanger;

a first tube joined to and extending from the first tubular header in a core width direction of the heat exchanger to the return header, the first tube being one of a first row of tubes;

a second tube joined to and extending from the second tubular header in the core width direction to the return header, the second tube being one of a second row of tubes, a flat outer surface of the second tube being arranged to be co-planar with a flat outer surface of the first tube;

a corrugated fin having a plurality of flanks joined by alternating crests and troughs, the troughs being joined to said flat outer surfaces of the first and second tubes; and a side plate having a planar base section extending between a first short side and a second short side, the planar base section and joined to the crests of the corrugated fin, a first slot extending through the planar base section and disposed between the first and second tubes, and a second slot extending through the planar base section and disposed over the first tube, wherein the second slot is separated from the first slot by a breaking point, the breaking point being located offset from a planar base section center line extending in the width direction, wherein the first short side of the side plate is joined to the first tubular header and the second tubular header, wherein the second short side of the side plate is joined to the return header, and wherein the first tube is fluidly connected to the second tube to at least partially define a fluid flow path from the first header to the second header.

20. The heat exchanger of claim 19, wherein the side plate includes a third slot extending through the planar base section and disposed over the second tube, and wherein the first slot is located in a short dimension direction transverse to the width direction at least partially between the second slot and the third slot.

* * * * *